US009261108B2

(12) United States Patent
Van Deventer

(10) Patent No.: US 9,261,108 B2
(45) Date of Patent: Feb. 16, 2016

(54) HVAC BLOWER IMPELLER

(71) Applicant: Trane International Inc., Piscataway, NJ (US)

(72) Inventor: Patrick William Van Deventer, Tyler, TX (US)

(73) Assignee: Trane International Inc., Piscataway, NJ (US)

( * ) Notice: Subject to any disclaimer, the term of this patent is extended or adjusted under 35 U.S.C. 154(b) by 420 days.

(21) Appl. No.: 13/962,678

(22) Filed: Aug. 8, 2013

(65) Prior Publication Data

US 2015/0044051 A1 Feb. 12, 2015

(51) Int. Cl.
*F04D 29/38* (2006.01)
*F04D 29/28* (2006.01)

(52) U.S. Cl.
CPC ..... *F04D 29/283* (2013.01); *F04D 29/282* (2013.01); *F04D 29/281* (2013.01)

(58) Field of Classification Search
CPC .... F04D 29/281; F04D 29/282; F04D 29/283
USPC ..... 416/178, 187, 203
See application file for complete search history.

(56) References Cited

U.S. PATENT DOCUMENTS

| | | | | |
|---|---|---|---|---|
| 1,075,120 | A | 10/1913 | Rogers | |
| 2,878,989 | A | 3/1959 | Sprouse | |
| 5,611,667 | A | 3/1997 | Nagamori et al. | |
| 6,158,954 | A | 12/2000 | Nabeshima et al. | |
| 7,210,907 | B2 | 5/2007 | Patti | |
| 8,057,185 | B2 * | 11/2011 | Brendel | F04D 29/283 415/53.1 |

* cited by examiner

*Primary Examiner* — Ching Chang
(74) *Attorney, Agent, or Firm* — Conley Rose, P.C.; J. Robert Brown, Jr.; Michael J. Schofield

(57) ABSTRACT

An impeller has an impeller axis, a first blade support, a second blade support, a third blade support, a plurality of first blades extending between the first blade support and the second blade support, and a plurality of second blades extending between the second blade support and the third blade support. An angular location of attachment of the first blades to the first blade support is angularly offset from an angular location of attachment of the first blades to the second blade support in a first angular direction, wherein an angular location of attachment of the second blades to the third blade support is angularly offset from an angular location of attachment of the second blades to the second blade support in the first angular direction, and wherein the second blade support is configured to allow airflow longitudinally through the interior of the impeller.

21 Claims, 11 Drawing Sheets

HVAC BLOWER IMPELLER

CROSS-REFERENCE TO RELATED APPLICATIONS

Not applicable.

STATEMENT REGARDING FEDERALLY SPONSORED RESEARCH OR DEVELOPMENT

Not applicable.

REFERENCE TO A MICROFICHE APPENDIX

Not applicable.

BACKGROUND

Heating, ventilation, and/or air conditioning (HVAC) systems sometimes comprise blowers that output air with non-homogeneous velocity contours.

BRIEF DESCRIPTION OF THE DRAWINGS

For a more complete understanding of the present disclosure and the advantages thereof, reference is now made to the following brief description, taken in connection with the accompanying drawings and detailed description, wherein like reference numerals represent like parts.

DETAILED DESCRIPTION

Some HVAC systems comprise blowers that provide airflow outputs with less than desirable velocity contours. In some embodiments of this disclosure, impellers are provided that comprise chevron blade patterns as well as relatively unrestrictive impeller interior spaces.

Figure 1:
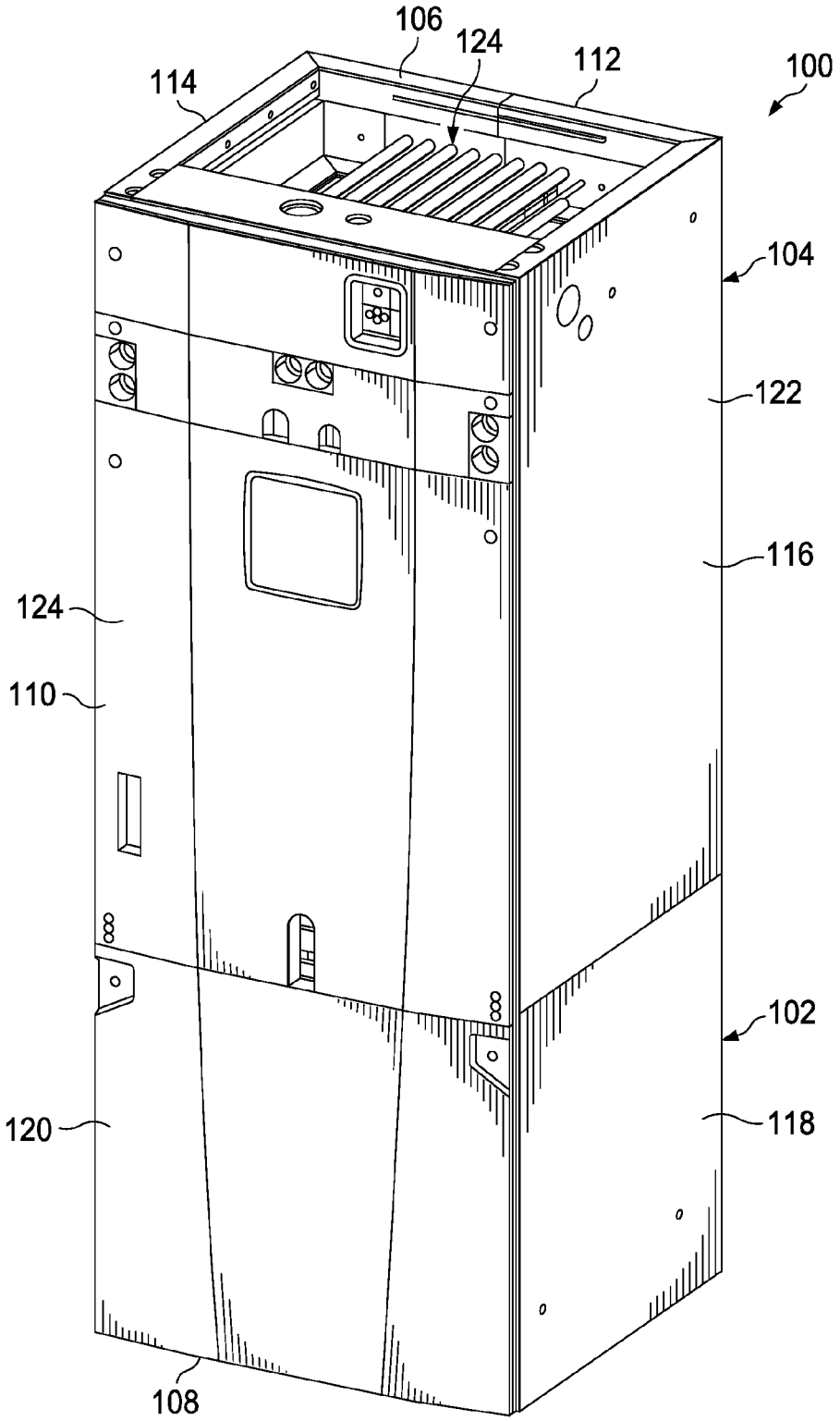
FIG. 1 is an oblique view of an air handling unit according to embodiments of the disclosure.
Figure 2:
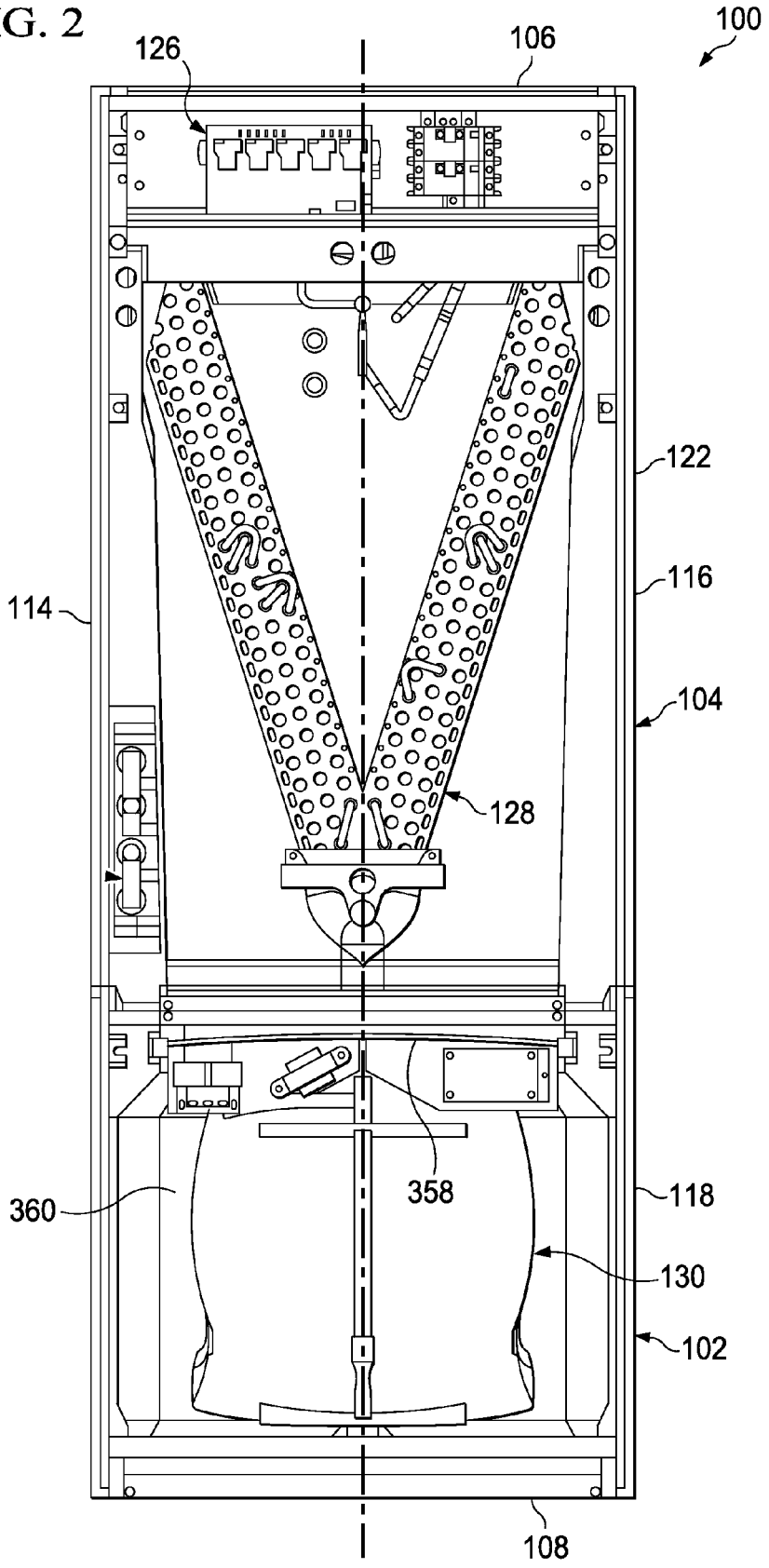
FIG. 2 is an orthogonal view of the front of the air handling unit of FIG. 1.
Figure 3:
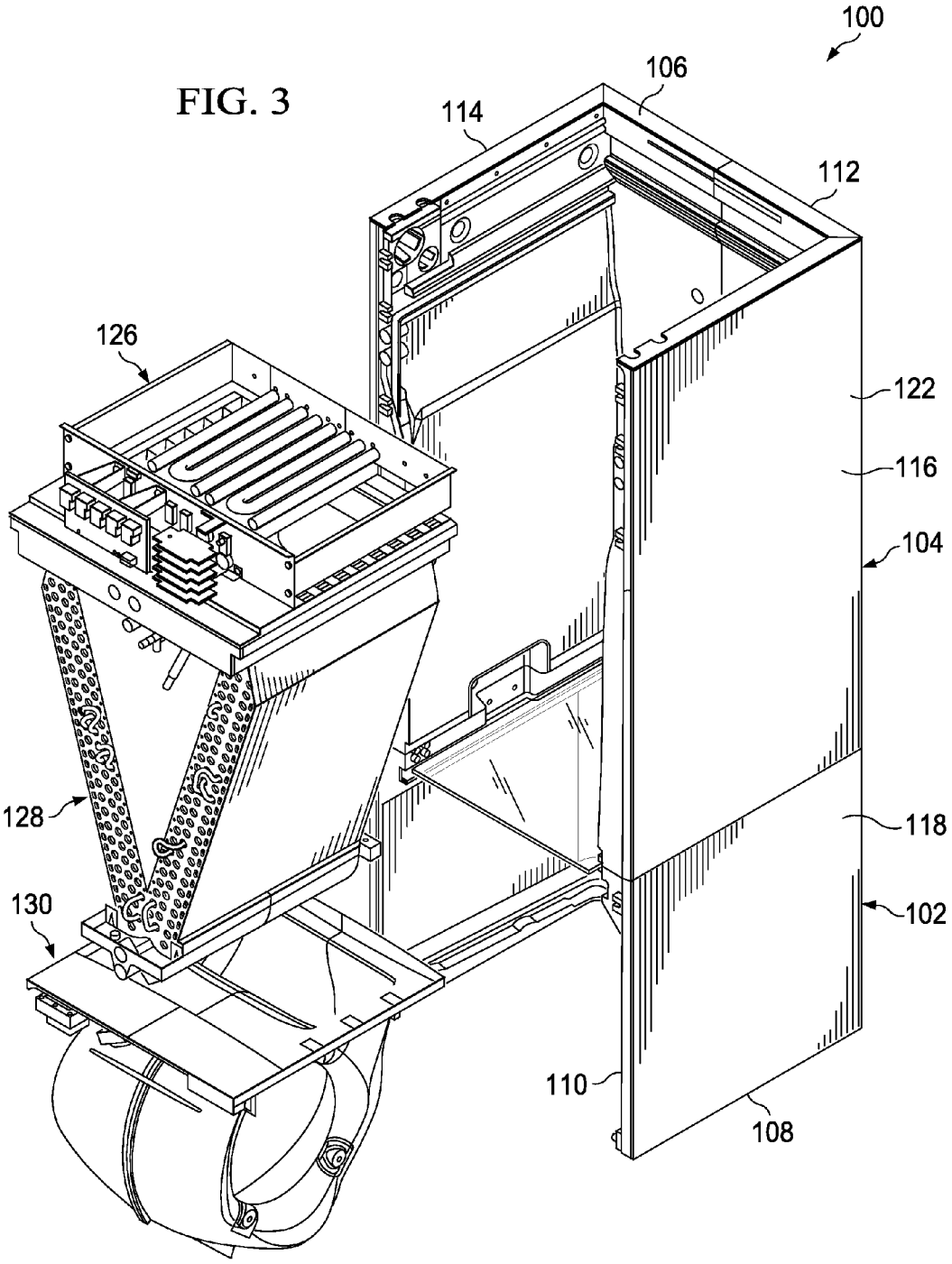
FIG. 3 is a partially exploded oblique view of the air handling unit of FIG. 1.

Referring now to FIGS. 1-3, an air handling unit (AHU) 100 according to the disclosure is shown. In this embodiment, AHU 100 comprises a lower blower cabinet 102 attached to an upper heat exchanger cabinet 104. Most generally and for purposes of this discussion, AHU 100 may be described as comprising a top side 106, a bottom side 108, a front side 110, a back side 112, a left side 114, and a right side 116. Such directional descriptions are meant to assist the reader in understanding the physical orientation of the various components parts of the AHU 100 but such directional descriptions shall not be interpreted as limitations to the possible installation orientations of an AHU 100. Further, the above-listed directional descriptions may be shown and/or labeled in the figures by attachment to various component parts of the AHU 100. Attachment of directional descriptions at different locations or two different components of AHU 100 shall not be interpreted as indicating absolute locations of directional limits of the AHU 100, but rather, that a plurality of shown and/or labeled directional descriptions in a single Figure shall provide general directional orientation to the reader so that directionality may be easily followed amongst various figures. Still further, the component parts and/or assemblies of the AHU 100 may be described below as generally having top, bottom, front, back, left, and right sides which should be understood as being consistent in orientation with the top side 106, bottom side 108, front side 110, back side 112, left side 114, and right side 116 of the AHU 100.

Blower cabinet 102 comprises a four-walled fluid duct that accepts fluid (air) in through an open bottom side of the blower cabinet 102 and allows exit of fluid through an open top side of the blower cabinet 102. In this embodiment, the exterior of the blower cabinet 102 comprises a blower cabinet outer skin 118 and a blower cabinet panel 120. The blower cabinet panel 120 is removable from the remainder of the blower cabinet 102 thereby allowing access to an interior of the blower cabinet 102. Similarly, heat exchanger cabinet 104 comprises a four-walled fluid duct that accepts fluid (air) from the blower cabinet 102 and passes the fluid from an open bottom side of the heat exchanger cabinet 104 and allows exit of the fluid through an open top side of the heat exchanger cabinet 104. In this embodiment, the exterior of the heat exchanger cabinet 104 comprises a heat exchanger cabinet outer skin 122 and a heat exchanger cabinet panel 124. The heat exchanger cabinet panel 124 is removable from the remainder of the heat exchanger cabinet 104 thereby allowing access to an interior of the heat exchanger cabinet 104.

The AHU 100 further comprises a plurality of selectively removable components. More specifically, the AHU 100 comprises a heater assembly 126 and may be removably carried within the heat exchanger cabinet 104. The AHU 100 further comprises a refrigeration coil assembly 128 that may also be removably carried within the heat exchanger cabinet 104. In this embodiment, the heater assembly 126 is configured to be optionally carried within heat exchanger cabinet 104 nearer the top side 106 of the AHU 100 than the refrigeration coil assembly 128. Similarly, the AHU 100 comprises a blower assembly 130 that may be removably carried within the blower cabinet 102. The AHU 100 may be considered fully assembled when the blower assembly 130 is carried within the blower cabinet 102, each of the refrigeration coil assembly 128 and the heater assembly 126 are carried within the heat exchanger cabinet 104, and when the blower cabinet panel 120 and heat exchanger cabinet panel 124 are suitably associated with the blower cabinet outer skin 118 and the heat exchanger cabinet outer skin 122, respectively. When the AHU 100 is fully assembled, fluid (air) may generally follow a path through the AHU 100 along which the fluid enters through the bottom side 108 of the AHU 100, successively encounters the blower assembly 130, the refrigeration coil assembly 128, and the heater assembly 126, and thereafter exits the AHU 100 through the top side 106 of the AHU 100.

Figure 4:
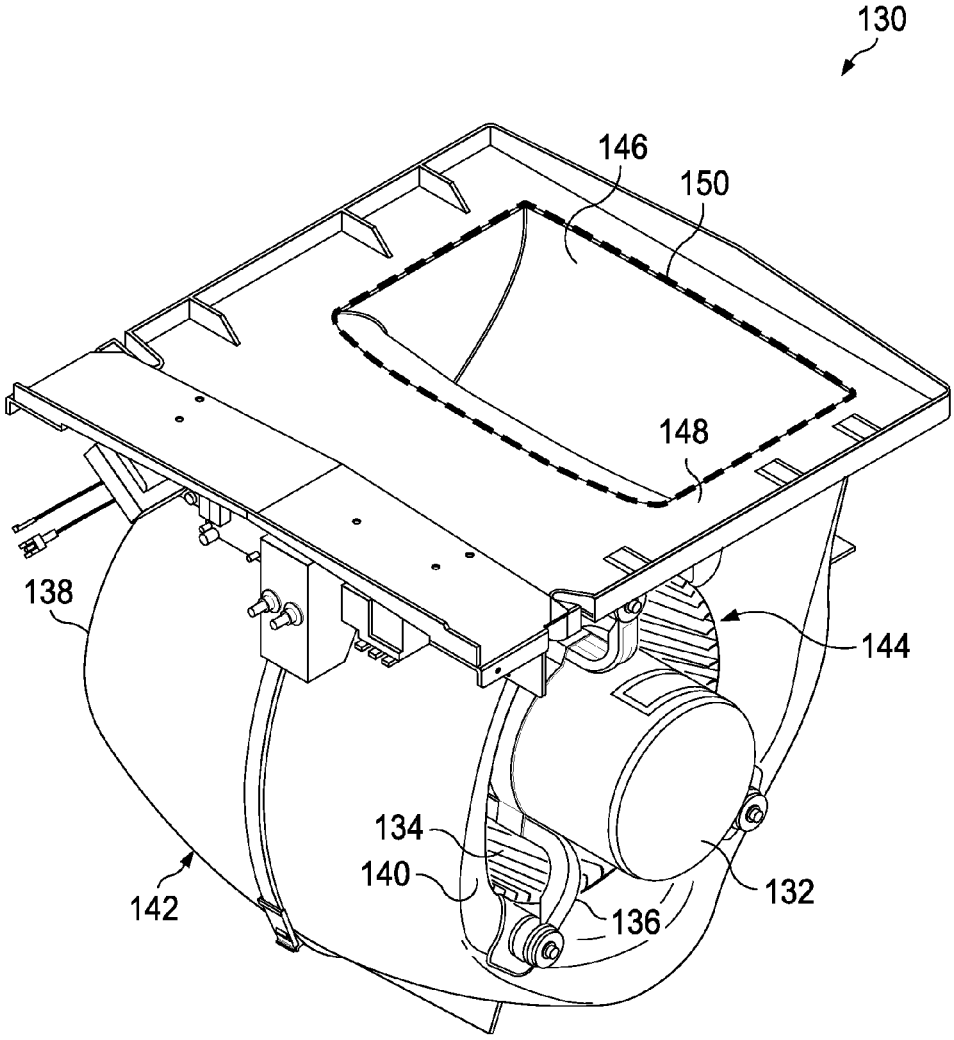
FIG. 4 is an oblique view of a blower assembly of FIG. 2 from a front-upper-right viewpoint.

Referring now to FIG. 4, the blower assembly 130 is shown in greater detail. FIG. 4 is an oblique view of the blower assembly 130 from a front-upper-right viewpoint. The blower assembly 130 comprises a motor 132 comprising a shaft upon which an impeller 134 is mounted. In this embodiment, the blower assembly 130 comprises a centrifugal type fan sometimes referred to as a squirrel cage type blower. The motor 132 is attached to a motor mount 136 that holds the motor 132 in place relative to a left shell 138 of the blower assembly 130 and a right shell 140 of the blower assembly 130. In this embodiment, left shell 138 and the right shell 140 are selectively joined together via integral snap features as well as retaining clips. When joined, left shell 138 and the right shell 140 may be conceptualized as defining two distinct functional portions of the blower assembled 130.

One functional portion of the blower assembly 130 may be referred to as the blower housing 142. A primary function of the blower housing 142 is to receive at least a portion of each of the motor 132 and the impeller 134 while also defining an intermediate air path between each of a left air input port of the blower assembly 130 and a right air input port 144 of the blower assembly 130 and the blower output 146. It is the shape of the interior of the blower housing 142 in combination with the movement of the impeller 134 that allows the optional intake of air through the right air input port 144 and the left air input port and subsequent output of that air through the blower output 146. Another functional portion of the blower assembly 130 may be referred to as the blower deck 148. A first primary function of the blower deck 148 is to serve as a physical component used in mounting the entire blower assembly 130 within and relative to the blower cabinet 102. A second primary function of the blower deck 148 is to serve as a substantial air pressure barrier between the portion of the interior of the blower cabinet 102 that houses the blower assembly 130 and the interior of, in this embodiment, the heat exchanger cabinet 104. Because the blower housing 142 and the blower deck 148 are substantially integrally formed when the left shell 138 is joined to the right shell 140, the blower housing and the blower deck 148 may be conceptualized as being joined along an interface path 150. In this embodiment, interface path 150 comprises the points at which an inner surface of the blower assembly 130 begins to primarily extend at least one of a left, right, front, and/or rear direction. Accordingly, in this embodiment, the interference path 150 generally denotes a perimeter of the blower output 146.

Figure 5:
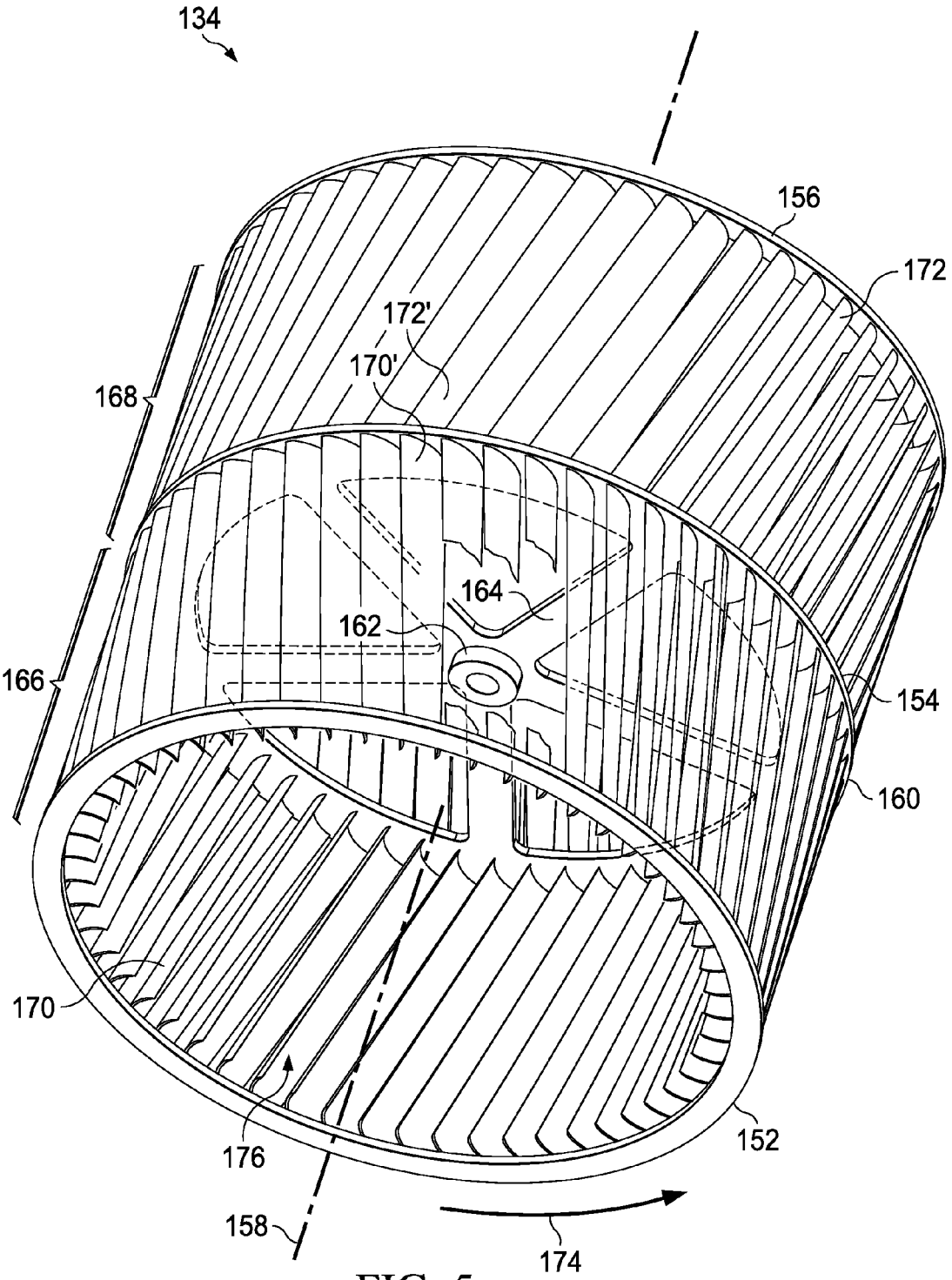
FIG. 5 is an oblique view of an impeller of the blower assembly of FIG. 2.
Figure 6:
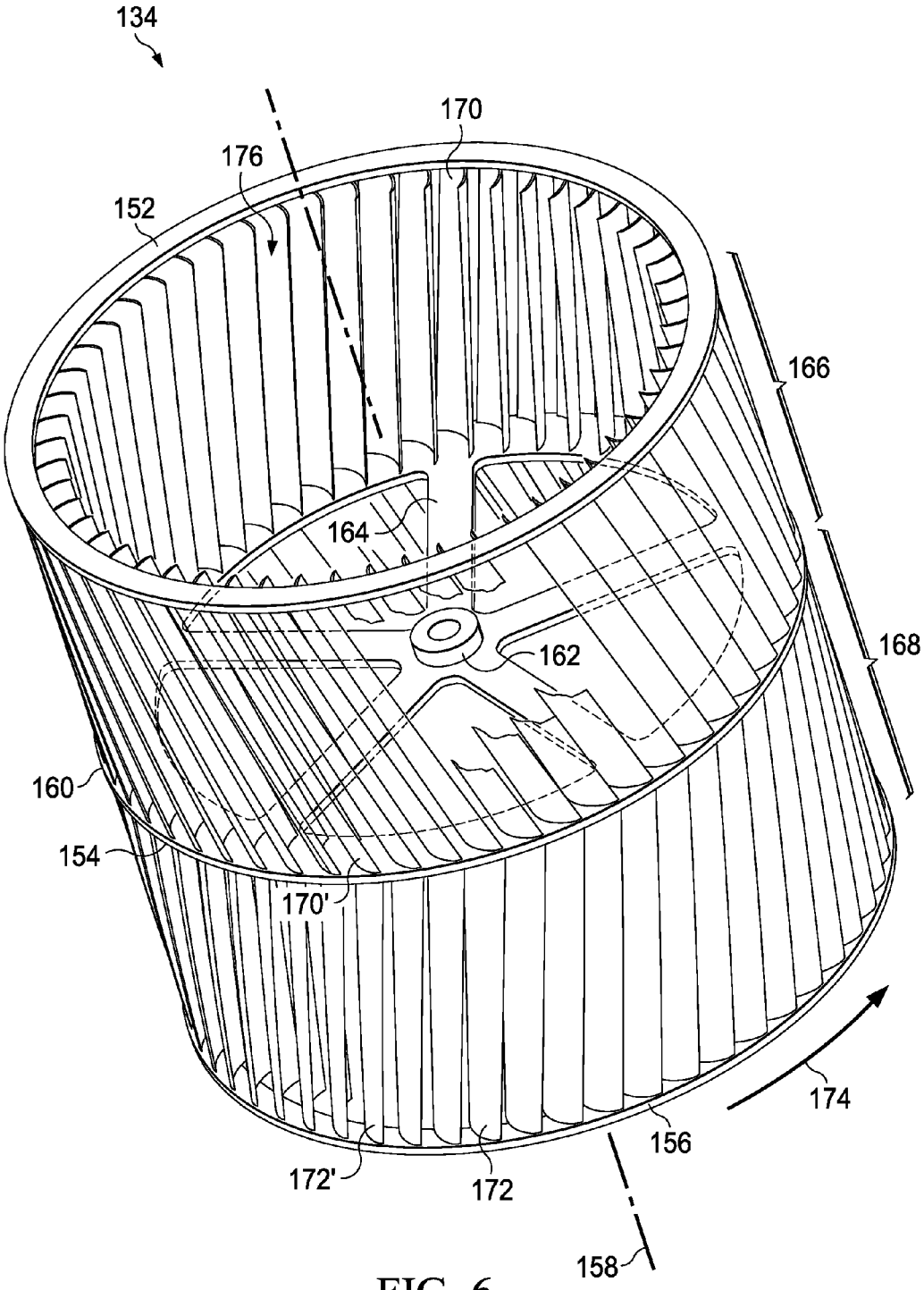
FIG. 6 is another oblique view of the impeller of the blower assembly of FIG. 2.
Figure 7:
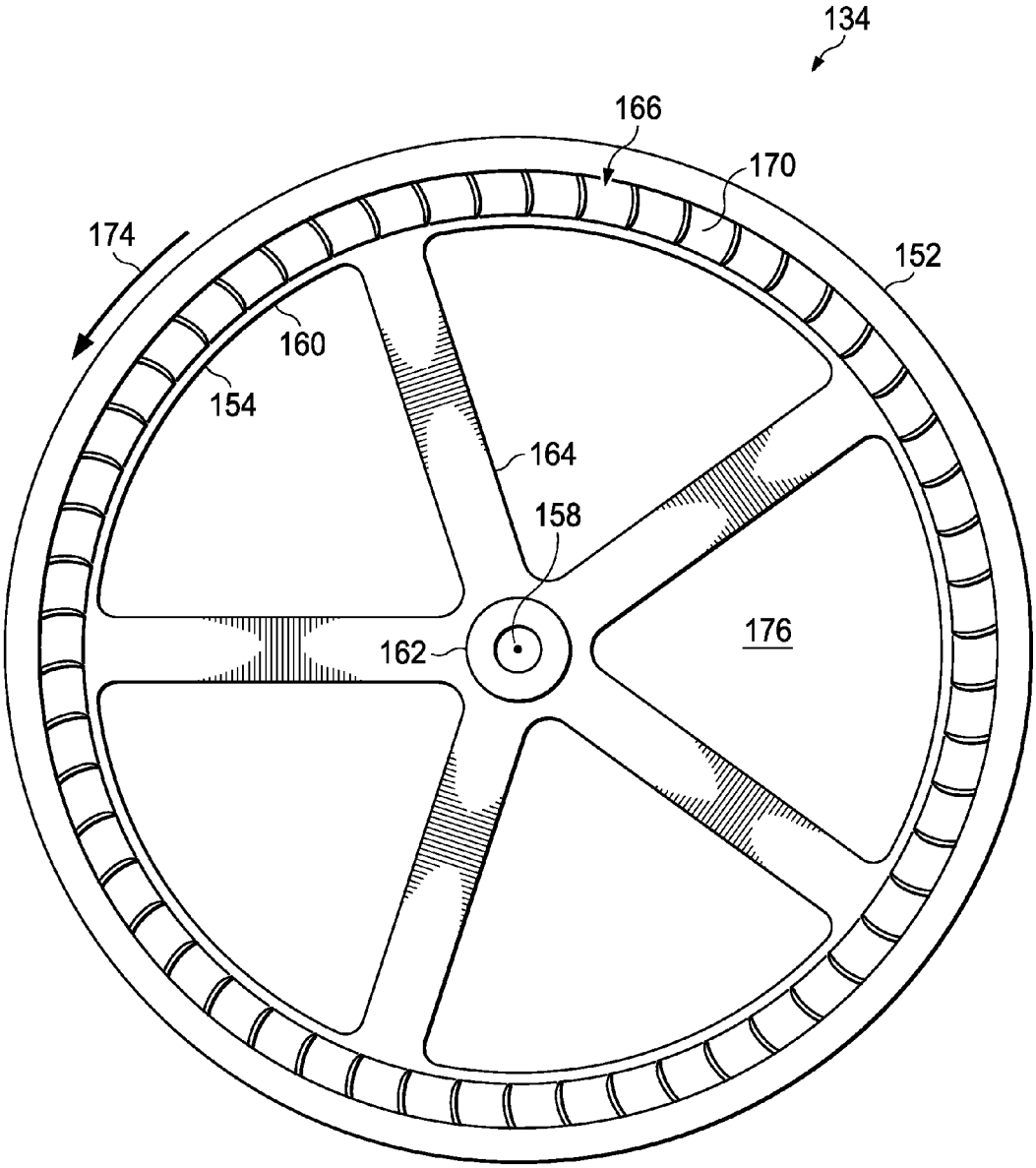
FIG. 7 is an orthogonal right side view of the impeller of the blower assembly of FIG. 2.

Referring now to FIGS. 5-7, oblique right, oblique left, and orthogonal right views of the impeller 134 are shown. Impeller 134 generally comprises a first blade support 152, a second blade support 154, and a third blade support 156. The first blade support 152 and the third blade support 156 are each configured as rings and/or annular plates substantially coaxially disposed along an impeller axis 158. The second blade support 154 is configured as a spoked wheel comprising an outer ring 160 connected to a hub 162 via spokes 164. The hub 162 is configured to receive a shaft of the motor 132. Most generally, the impeller 134 may be characterized as comprising a first blade section 166 and a second blade section 168. The first blade section 166 comprises blades 170 that extend between the first blade support 152 and the second blade support 154 while the second blade section 168 comprises blades 172 that extend between the second blade support 154 and the third blade support 156. In this embodiment, the impeller 134 is configured primarily for rotation in a first angular direction 174 about the impeller axis 158. The blades 170, 172 are configured to comprise a concave shape that is generally open toward the direction first angular direction 174. Further, blades 170, 172 do not lie substantially parallel to the impeller axis 158. Instead, when angular displacement about the impeller axis 158 in the first angular direction 174 is considered an increase in angular value, a blade 170 is attached to the first blade support 152 at an angular location about the impeller axis 158 that is generally angularly lagging relative to the angular location at which the blade 170 is attached to the second blade support 154. Similarly, when angular displacement about the impeller axis 158 in the first angular direction 174 is considered an increase in angular value, a blade 172 is attached to the third blade support 156 at an angular location about the impeller axis 158 that is generally angularly lagging relative to the angular location at which the blade 172 is attached to the second blade support 154. As such, the first blade section 166 and the second blade section 168 may be characterized as comprising opposing and/or discontinuous attachment directions relative to the second blade support 154. In other words, even though in this embodiment a blade attachment location of a blade 170 on the second blade support 154 may be generally longitudinally aligned with a blade attachment location of a blade 172 on the second blade support 154, the blade 172 does not continue a lengthwise path projected from the blade 170. Accordingly, as viewed from above, lengthwise paths of corresponding blades 170, 172 such as corresponding blades 170', 172' may form a portion of a chevron pattern or a V-pattern. In this embodiment the angular offsets between the ends of the blades 170 relative to the angular offsets between the ends of the blades 172 are substantially equal so that corresponding blades such as 170', 172' generally mirror each other about a longitudinal bisection plane extending through the second blade support 154 and normal to the impeller axis 158. However, in alternative embodiments, the angular offsets may be different between corresponding blades such as 170', 172'. The second blade support 154 is substantially open between angularly adjacent spokes 164 in such a manner that air is relatively unrestricted from passage and/or pressure equalization within an interior space 176 of the impeller 134 that lies generally radially inward of the radially innermost edges of blades 170, 172. In alternative embodiments, the second blade support 154 may comprise a ring with no spokes and the impeller 134 may be belt driven and/or the hubs may be located on one or both of the first and third blade supports 152, 156 via supporting spokes.

Figure 8:
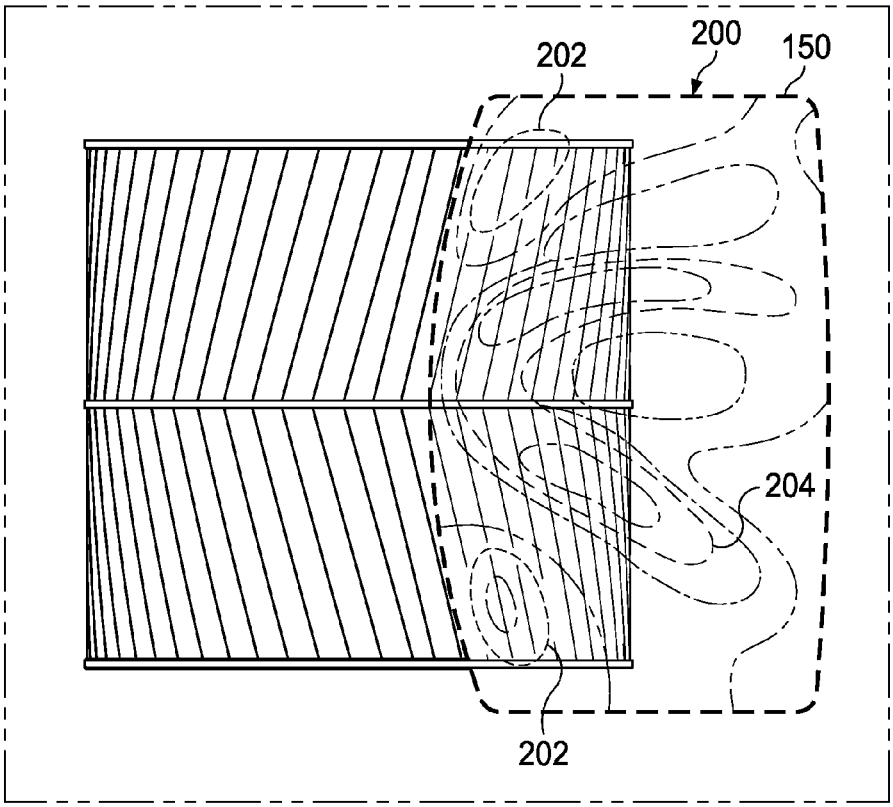
FIG. 8 is an output velocity contour of the impeller of the blower assembly of FIG. 2.
Figure 9:
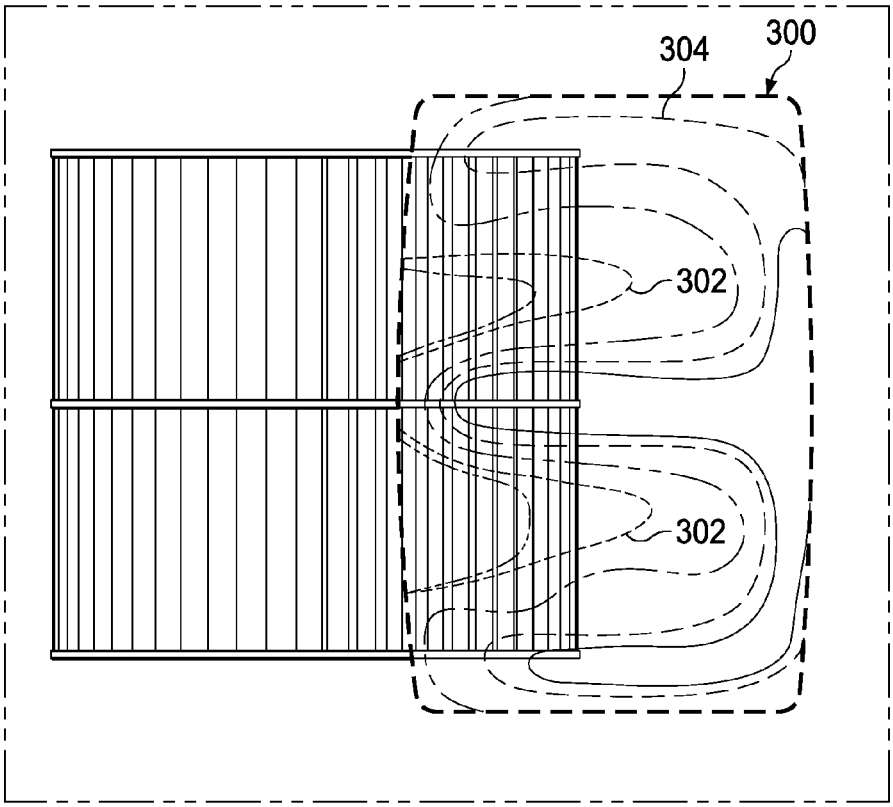
FIG. 9 (PRIOR ART)
FIG. 9 is an output velocity contour of a prior art impeller.

Referring now to FIGS. 8 and 9, velocity contour maps for an impeller output of impeller 134 of blower assembly 130 and a blower assembly comprising a prior art impeller are shown, respectively. FIG. 8 shows a velocity contour 200 that comprises relatively small pockets 202 of relatively high velocity near forward corners of the blower output that is substantially associated with interference path 150. The velocity contour 200 further comprises a small U-shaped pocket 204 of relatively high velocity. Even with the above-identified relatively higher velocity pockets 202, 204, the velocity contour 200 is substantially more homogenous as compared to the velocity contour of FIG. 9. Relative to FIG. 8, FIG. 9 shows a less homogenous velocity contour 300 that comprises very large pockets 302 of low velocity and a very large E-shaped pocket 304 of high velocity. It will be appreciated that the improved homogeneity of the velocity contour 200 relative to the velocity contour 300 is attributable to the configuration of the impeller 134 as described above and the differences between impeller 134 and a traditional straight-bladed impeller with a substantially solid central blade support.

Figure 10:
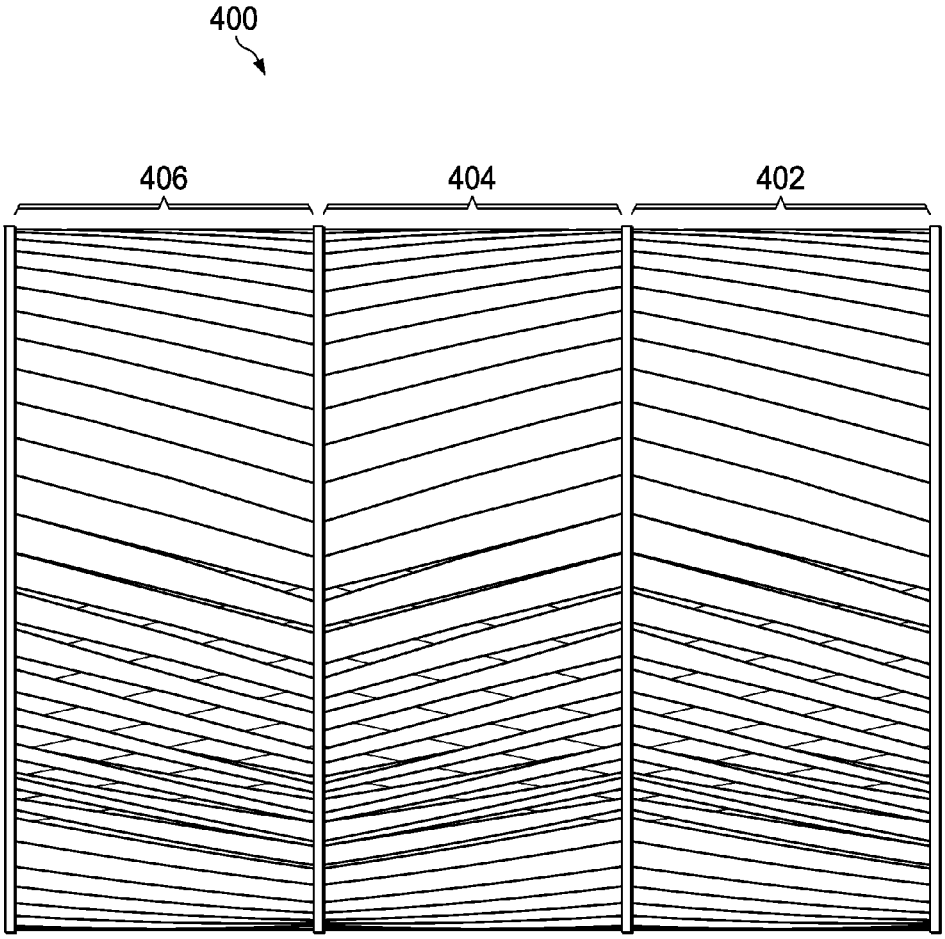
FIG. 10 is a schematic view of an alternative embodiment of an impeller.

Referring now to FIG. 10, a schematic representation of an alternative embodiment of an impeller 400 is shown. In this embodiment, the impeller 400 comprises three blade sections 402, 404, and 406. Blade sections 402 and 404 are substantially similar to blade sections 166 and 168, respectively. Unlike impeller 134, impeller 400 comprises a third blade section 406 that is substantially similar to the first blade section 402. In this embodiment, an angular offset directionality change is maintained between immediately adjacent blade sections 402, 404, 406.

Figure 11:
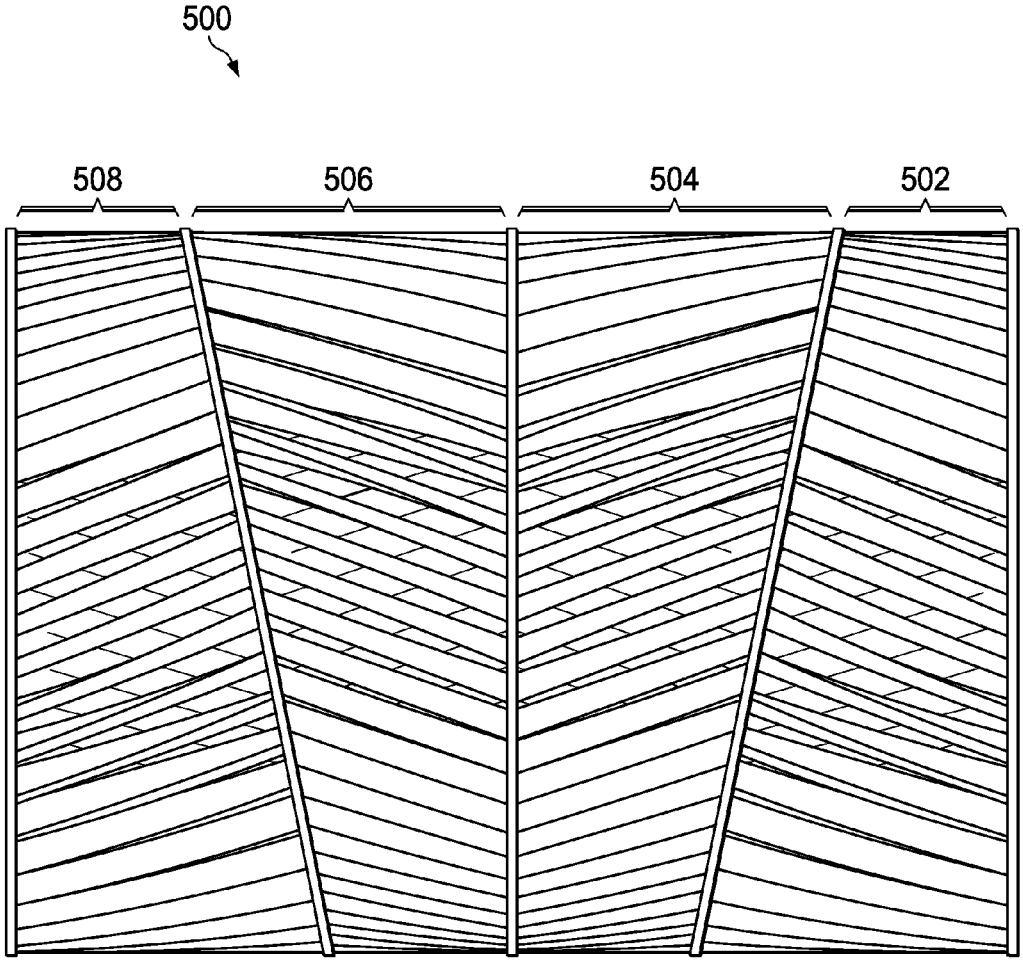
FIG. 11 is a schematic view of another alternative embodiment of an impeller.

Referring now to FIG. 11, a schematic representation of an alternative embodiment of an impeller 500 is shown. In this embodiment, the impeller 500 comprises four blade sections 502, 504, 506, and 508. Similar to impeller 400, an angular offset directionality change is maintained between immediately adjacent blade sections 502, 504, 506, and 508. However, unlike impellers 134 and 400, the blade sections comprise unequal blade lengths about the axis of rotation the impeller.

Figure 12:
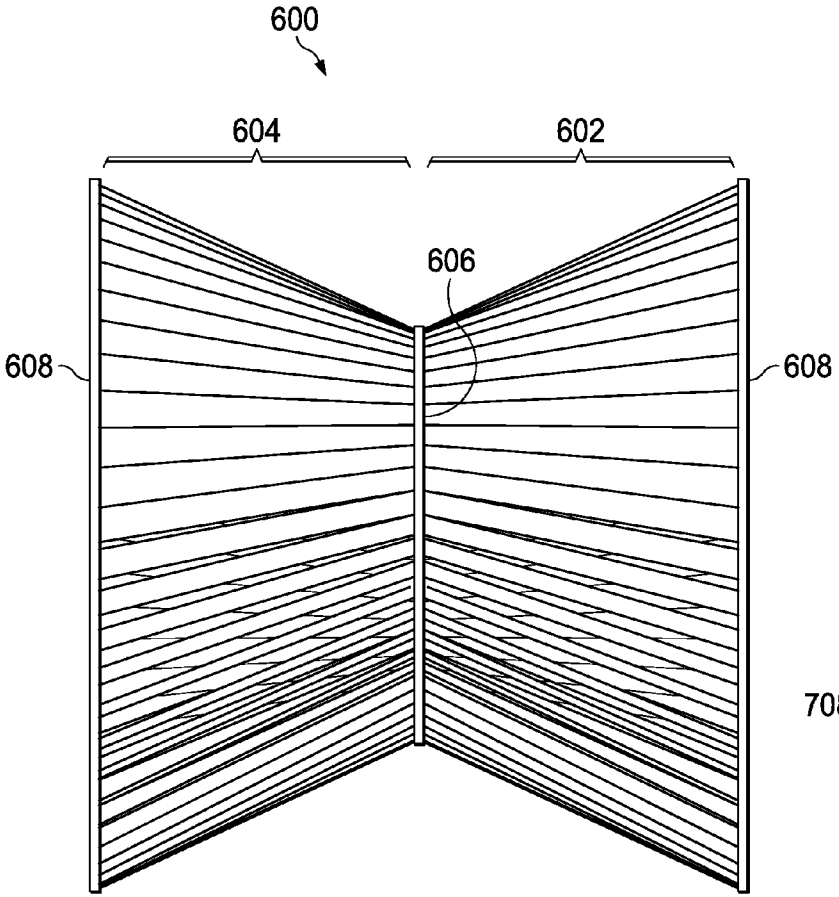
FIG. 12 is a schematic view of still another alternative embodiment of an impeller.

Referring now to FIG. 12, a schematic representation of an alternative embodiment of an impeller 600 is shown. In this embodiment, the impeller 600 comprises two blade sections 602, 604. Similar to impeller 134, an angular offset directionality change is maintained between immediately adjacent blade sections 602, 604. However, unlike impeller 134, the ends of the blades of blade sections 602, 604 are not connected to blade supports at substantially a same radial distance from the impeller axis. Instead, a central blade support 606 comprises a substantially smaller diameter than outer blade supports 608.

Figure 13:
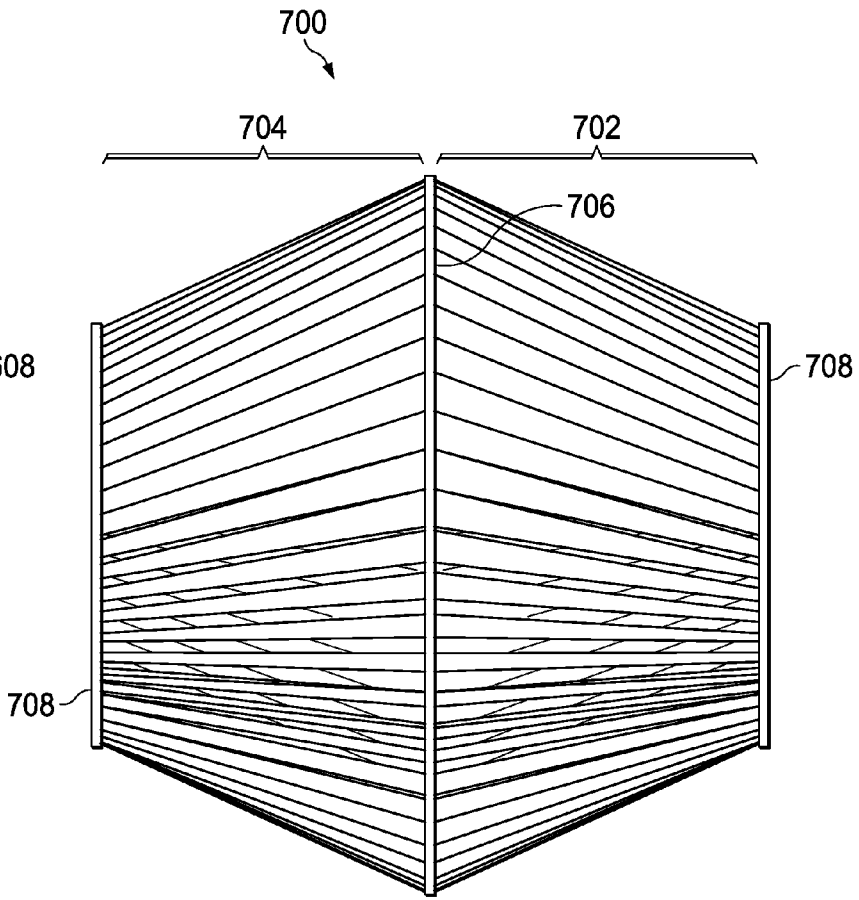
FIG. 13 is a schematic view of yet another alternative embodiment of an impeller.

Referring now to FIG. 13, a schematic representation of an alternative embodiment of an impeller 700 is shown. In this embodiment, the impeller 700 comprises two blade sections 702, 704. Similar to impeller 134, an angular offset directionality change is maintained between immediately adjacent blade sections 702, 704. However, unlike impeller 134, the ends of the blades of blade sections 702, 704 are not connected to blade supports at substantially a same radial distance from the impeller axis. Instead, a central blade support 706 comprises a substantially larger diameter than outer blade supports 708.

It will be appreciated that one or more of the impellers disclosed herein may selectively provide an improved air output velocity contour when the impeller is paired with a matched and/or appropriate blower housing. In some embodiments, the impeller interiors may remain substantially unobstructed by solid wheels and/or other blade supports that limit air transfer along a longitudinal length of the impeller interior.

At least one embodiment is disclosed and variations, combinations, and/or modifications of the embodiment(s) and/or features of the embodiment(s) made by a person having ordinary skill in the art are within the scope of the disclosure. Alternative embodiments that result from combining, integrating, and/or omitting features of the embodiment(s) are also within the scope of the disclosure. Where numerical ranges or limitations are expressly stated, such express ranges or limitations should be understood to include iterative ranges or limitations of like magnitude falling within the expressly stated ranges or limitations (e.g., from about 1 to about 10 includes, 2, 3, 4, etc.; greater than 0.10 includes 0.11, 0.12, 0.13, etc.). For example, whenever a numerical range with a lower limit, Rl, and an upper limit, Ru, is disclosed, any number falling within the range is specifically disclosed. In particular, the following numbers within the range are specifically disclosed: $R=Rl+k*(Ru-Rl)$, wherein k is a variable ranging from 1 percent to 100 percent with a 1 percent increment, i.e., k is 1 percent, 2 percent, 3 percent, 4 percent, 5 percent, . . . 50 percent, 51 percent, 52 percent, . . . , 95 percent, 96 percent, 97 percent, 98 percent, 99 percent, or 100 percent. Moreover, any numerical range defined by two R numbers as defined in the above is also specifically disclosed. Use of the term "optionally" with respect to any element of a claim means that the element is required, or alternatively, the element is not required, both alternatives being within the scope of the claim. Use of broader terms such as comprises, includes, and having should be understood to provide support for narrower terms such as consisting of, consisting essentially of, and comprised substantially of. Accordingly, the scope of protection is not limited by the description set out above but is defined by the claims that follow, that scope including all equivalents of the subject matter of the claims. Each and every claim is incorporated as further disclosure into the specification and the claims are embodiment(s) of the present invention.

What is claimed is:

1. An air handling unit, comprising:

an impeller comprising an impeller axis;

a first blade support;

a second blade support;

a third blade support;

a plurality of first blades extending between the first blade support and the second blade support; and a plurality of second blades extending between the second blade support and the third blade support;

wherein an angular location of attachment of the first blades to the first blade support is angularly offset from an angular location of attachment of the first blades to the second blade support in a first angular direction, wherein an angular location of attachment of the second blades to the third blade support is angularly offset from an angular location of attachment of the second blades to the second blade support in the first angular direction, and wherein the second blade support is configured to allow airflow longitudinally through an interior space of the impeller.

2. The air handling unit of claim 1, wherein associated first blades substantially mirror associated second blades about a longitudinal plane that is substantially orthogonal to the impeller axis.

3. The air handling unit of claim 1, wherein first blades and the second blades generally form a chevron pattern.

4. The air handling unit of claim 1, wherein the first blades and the second blades comprise concave surfaces open toward the first angular direction.

5. The air handling unit of claim 1, wherein the second blade support comprises a spoke.

6. The air handling unit of claim 1, wherein the second blade support comprises a hub.

7. The air handling unit of claim 1, further comprising:

a plurality of third blades extending from the third blade support and away from the plurality of second blades.

8. The air handling unit of claim 7, wherein the plurality of third blades are substantially similar to the plurality of first blades.

9. The air handling unit of claim 7, further comprising:

a fourth blade support;

wherein an angular location of attachment of the fourth blades to the third blade support is angularly offset from an angular location of attachment of the fourth blades to the third blade support.

10. The air handling unit of claim 9, wherein at least one of the first blade support, the second blade support, the third blade support, and the fourth blade support comprises a ring and is axially misaligned relative to the impeller axis.

11. An impeller for a centrifugal blower, comprising:

an impeller axis;

a first blade support;

a second blade support;

a third blade support;

a plurality of first blades extending between the first blade support and the second blade support; and a plurality of second blades extending between the second blade support and the third blade support;

wherein an angular location of attachment of the first blades to the first blade support is angularly offset from an angular location of attachment of the first blades to the second blade support in a first angular direction, wherein an angular location of attachment of the second blades to the third blade support is angularly offset from an angular location of attachment of the second blades to the second blade support in the first angular direction, and wherein the second blade support is configured to allow airflow longitudinally through the interior of the impeller.

12. The impeller of claim 11, wherein associated first blades substantially mirror associated second blades about a longitudinal plane that is substantially orthogonal to the impeller axis.

13. The impeller of claim 11, wherein first blades and the second blades generally form a chevron pattern.

14. The impeller of claim 11, wherein the first blades and the second blades comprise concave surfaces open toward the first angular direction.

15. The impeller of claim 11, wherein the second blade support comprises a spoke.

16. The impeller of claim 11, wherein the second blade support comprises a hub.

17. The impeller of claim 11, further comprising:

a plurality of third blades extending from the third blade support and away from the plurality of second blades.

18. The impeller of claim 17, wherein the plurality of third blades are substantially similar to the plurality of first blades.

19. The impeller of claim 17, further comprising:

a fourth blade support;

wherein an angular location of attachment of the fourth blades to the third blade support is angularly offset from an angular location of attachment of the fourth blades to the third blade support.

20. The impeller of claim 19, wherein at least one of the first blade support, the second blade support, the third blade support, and the fourth blade support comprises a ring and is axially misaligned relative to the impeller axis.

21. The impeller of claim 11, wherein each of the first blade support, the second blade support, and the third blade support are configured to substantially equally allow air to pass longitudinally along the impeller axis within the impeller interior.

* * * * *